US008220534B2

(12) United States Patent
Millet et al.

(10) Patent No.: US 8,220,534 B2
(45) Date of Patent: Jul. 17, 2012

(54) SAFETY DEVICE FOR AN OIL WELL AND ASSOCIATED SAFETY INSTALLATION

(75) Inventors: François Millet, Antony (FR); Joseph Girardi, Cormeilles en Parisis (FR); Christophe Michaud, Soignolles en Brie (FR)

(73) Assignee: Geoservices Equipements, Leblanc-Mesnil (FR)

( * ) Notice: Subject to any disclaimer, the term of this patent is extended or adjusted under 35 U.S.C. 154(b) by 666 days.

(21) Appl. No.: 11/991,005

(22) PCT Filed: Aug. 28, 2006

(86) PCT No.: PCT/FR2006/001996

§ 371 (c)(1), (2), (4) Date: Jul. 7, 2009

(87) PCT Pub. No.: WO2007/026072

PCT Pub. Date: Mar. 8, 2007

(65) Prior Publication Data

US 2009/0314485 A1 Dec. 24, 2009

(30) Foreign Application Priority Data

Aug. 30, 2005 (FR) ..... 05 08880

(51) Int. Cl.
*E21B 34/06* (2006.01)
*E21B 23/00* (2006.01)

(52) U.S. Cl. ..... 166/66.7; 166/332.8; 166/322

(58) Field of Classification Search ..... 166/66.6, 166/66.7, 332.8, 322
See application file for complete search history.

(56) References Cited

U.S. PATENT DOCUMENTS 3,874,634 A * 4/1975 Gazda ..... 251/319
4,002,202 A 1/1977 Huebsch et al.
(Continued)

FOREIGN PATENT DOCUMENTS

WO 99/05395 2/1999
(Continued)

OTHER PUBLICATIONS

International Search Report issued Feb. 13, 2007 in the International (PCT) Application of which the present application is the U.S. National Stage.

*Primary Examiner* — Giovanna Wright
(74) *Attorney, Agent, or Firm* — Wenderoth, Lind & Ponack, L.L.P.

(57) ABSTRACT

The invention relates to a safety device for an oil well and to the associated safety installation. The inventive device comprises a valve housing (40) which defines a fluid flow passage (52). The aforementioned housing (40) comprises a valve (48) which is used to seal the passage and which can move between an open position and a closed position and means for permanently biasing the valve towards the closed position thereof. The housing (40) also comprises releasable means (54) for connecting same to a working line with tubing that is intended to move the housing (40) in the conduit. In addition, the device comprises retractable means (42) for supporting the valve (58) in the open position and hydraulic means (44, 46) for actuating the support means (42) in order to activate same upon reception of a valve open control signal. The aforementioned support means (42) and actuation means (44, 46) are solidly connected to the housing (40) such that they can be moved simultaneously under the control of the line.

13 Claims, 6 Drawing Sheets

U.S. PATENT DOCUMENTS

| | | | | |
|---|---|---|---|---|
| 4,691,776 | A | 9/1987 | Pringle | |
| 5,251,702 | A | 10/1993 | Vazquez | |
| 6,216,784 | B1 | 4/2001 | Harrell | |
| 6,269,874 | B1 * | 8/2001 | Rawson et al. | 166/53 |
| 2002/0108747 | A1 | 8/2002 | Dietz et al. | |
| 2004/0045722 | A1 | 3/2004 | Sangla | |

FOREIGN PATENT DOCUMENTS

| | | |
|---|---|---|
| WO | 02/063129 | 8/2002 |
| WO | 03/072906 | 9/2003 |

* cited by examiner

SAFETY DEVICE FOR AN OIL WELL AND ASSOCIATED SAFETY INSTALLATION

BACKGROUND OF THE INVENTION

The present invention relates to a safety device for a fluid production well, of the type comprising:

- a valve housing intended to be fixed tightly inside a fluid flow conduit, the housing delimiting a fluid flow passage and comprising:
  - a valve used to seal the passage, and which can move between an open position of the passage and a closed position of the passage;
  - means for permanently biasing the valve towards its closed position; and
  - means for connecting the housing to a coupling member for a working wire line intended to move and anchor the housing in the conduit;
- means for holding the valve in the open position against the permanent biasing means, said holding means comprising at least one movement element for the valve, which can move in the valve housing between a rest position and an active valve biasing position, and an element for permanently returning the movement element to its rest position; and
- means for hydraulically actuating the holding means, which can be controlled by a control signal to actuate the holding means upon receipt of a valve open control signal by the actuating means, and to deactivate the holding means in the absence of said signal.

Such a device is used to secure a well for the production of oil or another fluid (notably gas, vapour or water), in particular when said well is eruptive and can be sealed rapidly in case of failure of the surface installation, said failure producing the disconnection of the open control signal.

A device of the above-mentioned type is known from U.S. Pat. No. 4,002,202, said device being lowered in a production casing of an oil well by means of a working wire line. Said device comprises a valve housing, a rod for holding the valve in the open position and electromagnetic coils for actuating the support rod. The coils are fixed to the outside of the casing at a determined point thereon on, and are connected electrically to the surface by electric cables.

When an electric control signal is received by the electromagnetic coils, the valve is held in the open position by the support rod, against a return spring.

In the absence of a control signal, the return spring is deployed to move the rod, which allows rapid sealing of the valve.

A safety device of the same type is also known, driven by a hydraulic control line extending outside the casing from the surface.

Such devices are not entirely satisfactory. The safety device must be positioned at a determined point of the well, opposite the actuating coils, and the coils must be connected to the surface by electric power supply lines, or must be positioned opposite the inlet of the hydraulic conduit.

SUMMARY OF THE INVENTION

An object of the invention is therefore to provide an autonomous safety device, comprising a safety valve that can be installed and anchored at any point of the well whatever the finished architecture thereof, and that can be controlled from the surface.

Accordingly, the invention relates to a device of the above-mentioned type, characterised in that the holding means and actuating means are connected to the housing in such a way that they can be moved simultaneously under the control of the working wire line.

The device according to the invention may comprise one or more of the following characteristics, taken in isolation or in a technically feasible combination:

- actuating means comprising a hydraulic cylinder and a hydraulic unit for controlling the cylinder;
- the hydraulic unit projects at least in part in relation to the housing, outside the flow passage, the flow passage being clear between the connection means and the valve;
- the hydraulic unit can be removed from the valve housing, said valve housing comprising means for receiving the unit;
- the cylinder comprises a chamber for pressurising control fluid, said chamber receiving a portion of the movement element of the valve; and a tank for reserving and discharging control fluid, and the hydraulic control unit comprises a pump for feeding the control fluid into the pressurising chamber, a pressurising conduit connecting the pressurising chamber to the discharge tank, a first discharge conduit connected to the pressurising conduit provided with a discharge valve that is open in the absence of the control signal and closed in the presence of said signal;

- the return element loads a piston for pressurising the tank;
- the actuating means comprise a rapid discharge conduit, connected to the pressurising conduit, the rapid discharge conduit being provided with a sealing element that can be released when the discharge valve is open;
- the maximum cross-section of the first discharge conduit and of the upstream portion of the pressurising conduit situated upstream of the releasable sealing element is less than the minimum cross-section of the rapid discharge conduit and of the downstream portion of the pressurising conduit situated downstream of the releasable sealing element;
- the actuating means comprise a control fluid accumulator connected to the pressurising chamber;
- the actuating means comprise a zero-leakage non-return valve, interposed between the pump and the pressurising chamber;
- the hydraulic unit comprises means for controlling the cylinder, said control means comprising a receiver, a control unit suitable for driving the cylinder to actuate the holding means upon receipt of a valve open control signal by the receiver and to deactivate said holding means in the absence of said signal;
- the control unit is suitable for driving the cylinder to actuate, at least temporarily, the holding means in the absence of a valve open signal, after reception of a silence signal by the receiver; and
- the device comprises releasable means for anchoring the housing in the conduit, carried by the housing.

The invention also relates to a safety installation for a fluid production well comprising a fluid flow conduit, said installation comprising:

- a device as defined above; and
- means for deploying said device in the conduit comprising a working wire line connected releasably to the connection means.

BRIEF DESCRIPTION OF THE DRAWINGS

The invention will be better understood on reading the description that follows, given solely by way of an example and with reference to the accompanying drawings, in which.

DETAILED DESCRIPTION OF THE INVENTION

Throughout the remaining text, the term "proximal" means relatively closer to the ground surface, whereas the term "distal" means relatively closer to the bottom of a well made in the ground.

The autonomous safety device 10 according to the invention, illustrated in FIGS. 1 to 6, is intended to be lowered into an oil well 12 using wire deployment means 14. The device 10 is placed at a chosen point in the well 12, for example situated at a depth of between 10 m and 1000 m, to replace a faulty safety valve, or to add an intermediate safety valve.

Figure 1A:
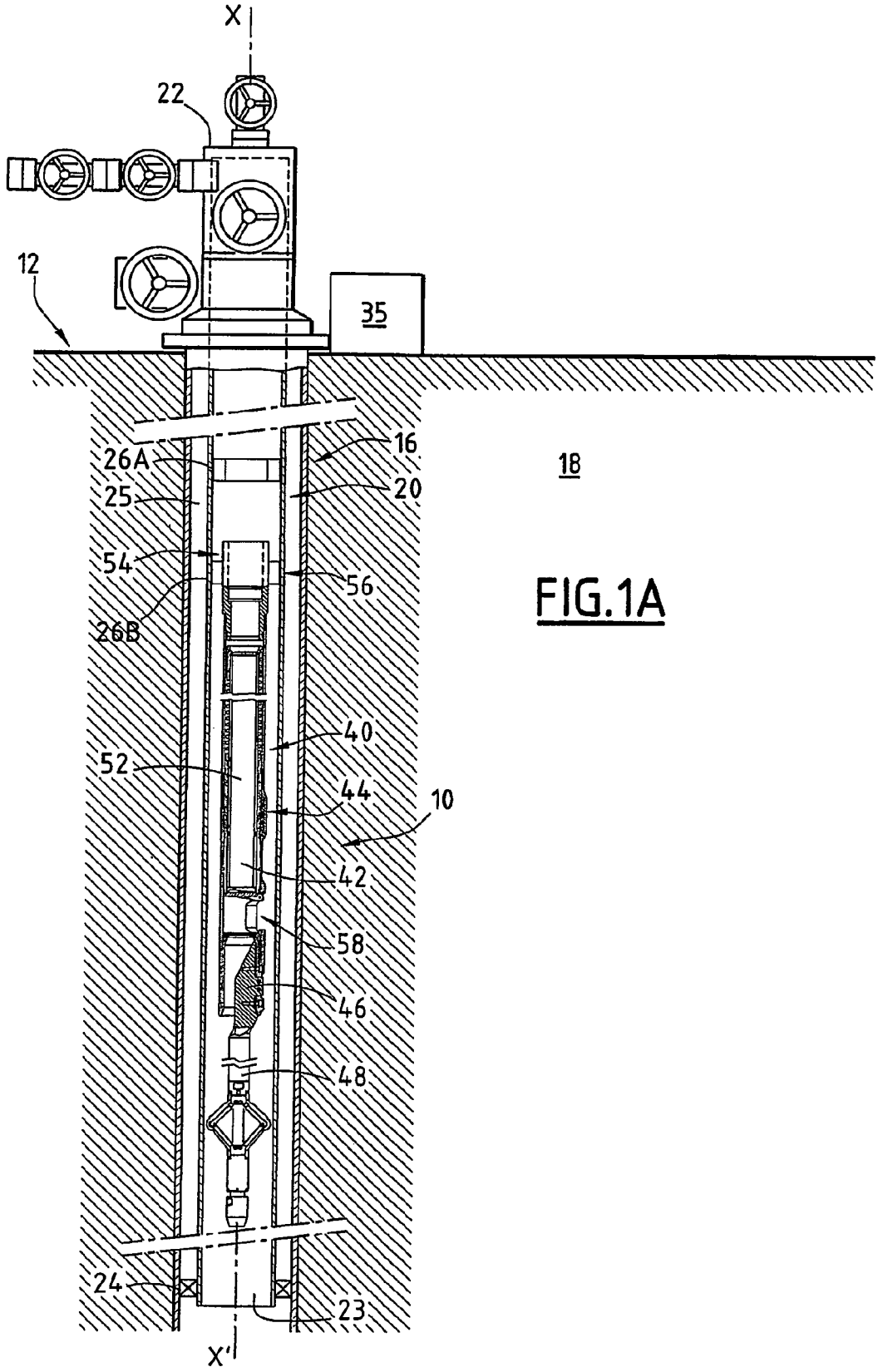
FIG. 1A is a cross-sectional view along a vertical mid-plane of an oil well equipped with a safety device according to the invention, during operation of the well.
Figure 1B:
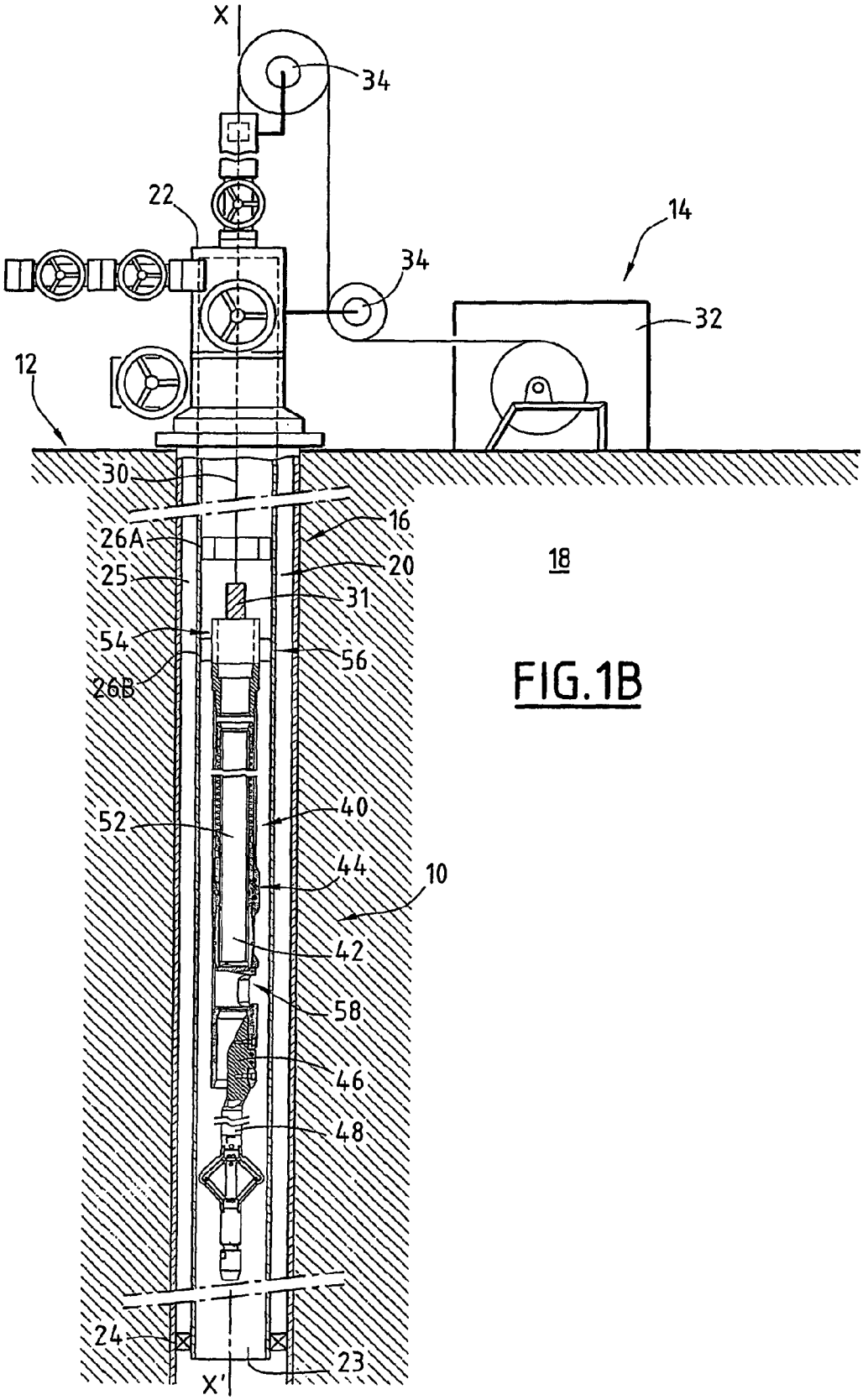
FIG. 1B is a similar view to FIG. 1A, when the device is installed in the well.

As illustrated in FIGS. 1A and 1B, the well 12 comprises a first conduit 16 known as the "casing" made in the sub-soil 18 and a second conduit or pipe 20 known as the "production casing" secured substantially in the centre of the first conduit 16.

The well 12 further comprises a wellhead 22 at the surface to seal selectively the first conduit 16 and the second conduit 20.

The second conduit 20 is not as long as the first conduit 16. It opens at a point 23 into the first conduit 16 situated in a distal portion of the well 12. Annular packing elements 24 are arranged between the first conduit 16 and the second conduit 20 in the vicinity of the point 23.

These elements 24 seal tightly the annular space 25 defined between the conduits 16 and 20.

The second conduit 20 defines internally a plurality of circular engagement grooves or annular engagement recesses 26A, 26B, designated by the term "landing nipple". Said recesses 26A, 26B are situated at points spaced longitudinally along the conduit 20.

In a variant, the second conduit 20 is not provided with recesses 26A, 26B, and the device 10 is anchored directly against a smooth wall of the conduit 20.

As illustrated in FIG. 1B, for the installation of the device 10 in the well 12, the deployment means 14 of the device 10 comprise a working wire line 30, a surface hoist 32 enabling the line 30 to be deployed or retracted in the well 12, and pulleys 34 for orienting the line 30 mounted on the wellhead 22.

The line 30 is formed for example by a smooth single strand wire of the "piano wire" type, commonly referred to by the term "slickline", with or without electrical insulation on its outer surface. The line 30 comprises, at its distal end, an installation gear 31 for the device 10.

In a variant, the line 30 is a mechanically reinforced electric cable, commonly referred to by the term "electric line", or a hollow spiral cable, commonly referred to by the term "coiled tubing".

The hoist 32 and the pulleys 34 allow the working line 30 to be deployed successively in the second conduit 20, then in the first conduit 16 via the wellhead 22.

As illustrated in FIG. 1A, when operating the well 12, the deployment means 14 have been withdrawn and the well 12 comprises means 35 for emitting a signal for controlling the safety device 10. In the example illustrated, the control signal is an electromagnetic signal and the means 35 are arranged at the surface. In a variant, said signal is an acoustic signal.

Figure 2:
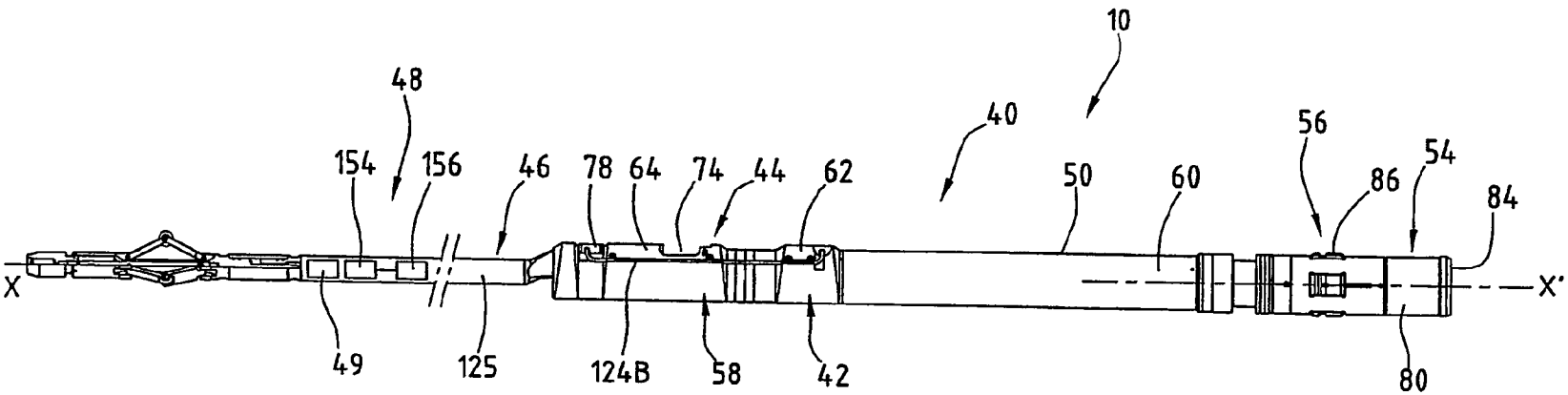
FIG. 2 is a side view of the safety device illustrated in FIG. 1A and in FIG. 1B.

As illustrated in FIG. 2, the safety device 10 comprises a safety valve housing 40, means 42 for holding the safety valve in an open position, and a hydraulic cylinder 44 for actuating the holding means 42. The device 10 also comprises a hydraulic unit 46 fixed removably at a distal end of the housing 40, the unit 46 comprising means 48 for controlling the cylinder 44, and batteries 49 for supplying electrical power to the unit 46.

Figure 3:
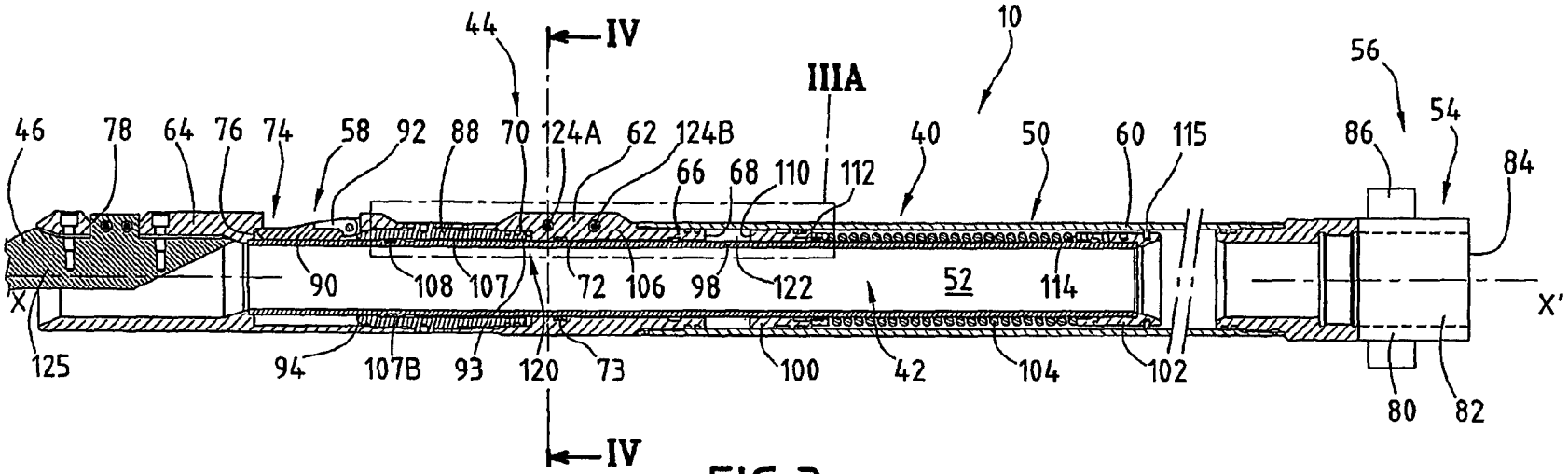
FIG. 3 is a cross-sectional view along a vertical mid-plane of a detail of the device in FIG. 2.

As illustrated in FIG. 3, the valve housing 40 comprises a tubular body 50 with a longitudinal axis X-X' delimiting internally a longitudinal through-flow passage 52 for circulating an oil fluid, means 54 for connecting to the installation gear 31, mounted at a proximal end of the body 50, and means 56 for anchoring the device 10 in the second conduit 20.

The housing 40 further comprises, in the vicinity of its distal end, a valve 58 for sealing the passage 52.

When moving from a proximal end, to the right in FIG. 3, to a distal end, to the left in FIG. 3, the body 50 comprises a proximal tubular portion 60, a portion 62 for guiding and holding the valve, and a distal portion 64 for connecting to the hydraulic unit 46.

Figure 3A:
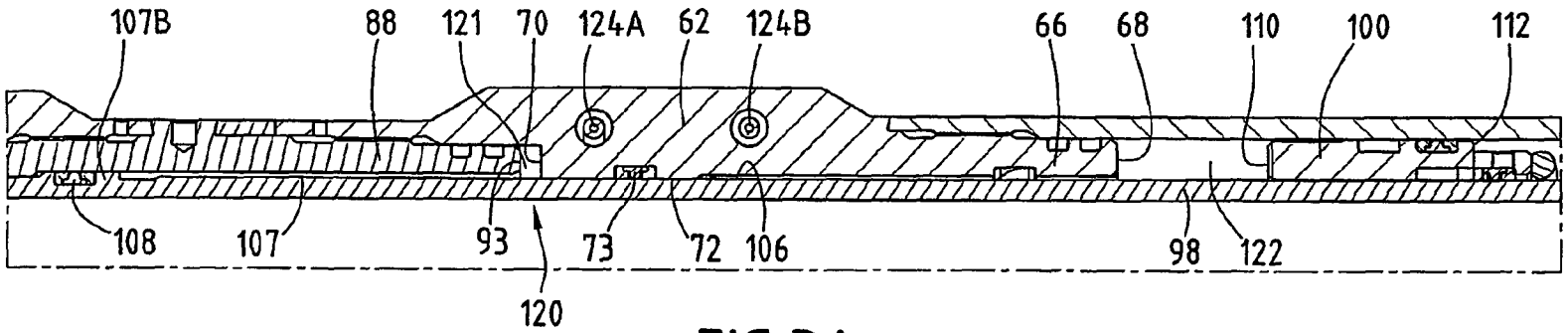
FIG. 3A is a view of a detail marked IIIA in FIG. 3.

As illustrated in FIG. 3A, the mid-portion 62 defines a proximal sheath 66 mounted in the tubular portion 60 and delimiting an annular transverse surface 68 directed towards the body 60.

The mid-portion 62 also delimits a distal annular shoulder 70 directed towards the distal portion 64 and a cylindrical guide surface 72 extending between the proximal surface 68 and the distal shoulder 70.

The cylindrical surface 72 delimits, between the distal shoulder 70 and the proximal surface 68, an annular recess which receives a proximal sealing gasket 73.

By moving distally along the axis X-X' in FIG. 3, the distal tubular portion 64 delimits a lateral valve retraction opening 74, which opens into the passage 52, an annular shoulder 76 oriented towards the distal end of the body 40, and a lateral passage 78 (i.e., a receiving portion) for assembling the hydraulic unit opening into the flow passage 52. The portion 64 has at its distal end a distal opening which opens into the flow passage 52.

The connection means 54 comprise a head 80 for receiving the installation gear 31 delimiting an internal recess 82. The head 80 is screwed to the proximal end of the tubular portion 60.

The recess 82 opens distally into the passage 52 and proximally through a proximal opening 84. A fluid may thus penetrate into the passage 52 of the housing 40 when the installation gear 31 is arranged at a distance from the housing 82.

The anchoring means 56 comprise lateral locking mandrels or "dogs" referred to by the term "lock mandrel". The dogs 86 project radially outside of the head 80 and have a form complementary to that of the engagement recesses 26A, 26B arranged in the second conduit 20.

The anchoring means 56 also comprise compressible annular packing (not illustrated) intended to form a seal between the wall of the conduit 20 and the head 80.

The sealing valve 58 comprises an annular seat 88 mounted integrally with the body 50 in the passage 52, and a shutter 90 that can move between an open position of the passage 52 and a sealed position of the passage 52. The valve 58 also comprises a spring 92 for returning the shutter 90 to its sealed position.

The valve seat 88 is fixed in the passage 52 and forms a mechanical connection between the mid-portion 62 and the distal tubular portion 64. As illustrated in FIG. 3A, a proximal annular surface 93 of the seat extends opposite the distal surface 70 of the mid-portion 62. A distal conical annular surface 94 of the seat 88 is flush with the wall of the distal portion 64 in the region of the lateral reception opening 74.

The shutter 90 can rotate about a horizontal axis perpendicular to the axis X-X' situated in the vicinity of the distal surface 94 of the seat 88.

In the open position of the shutter 90, said shutter 90 extends substantially in the extension of the tubular portion 64 to seal the lateral opening 74 and free the passage 52.

Figure 6:
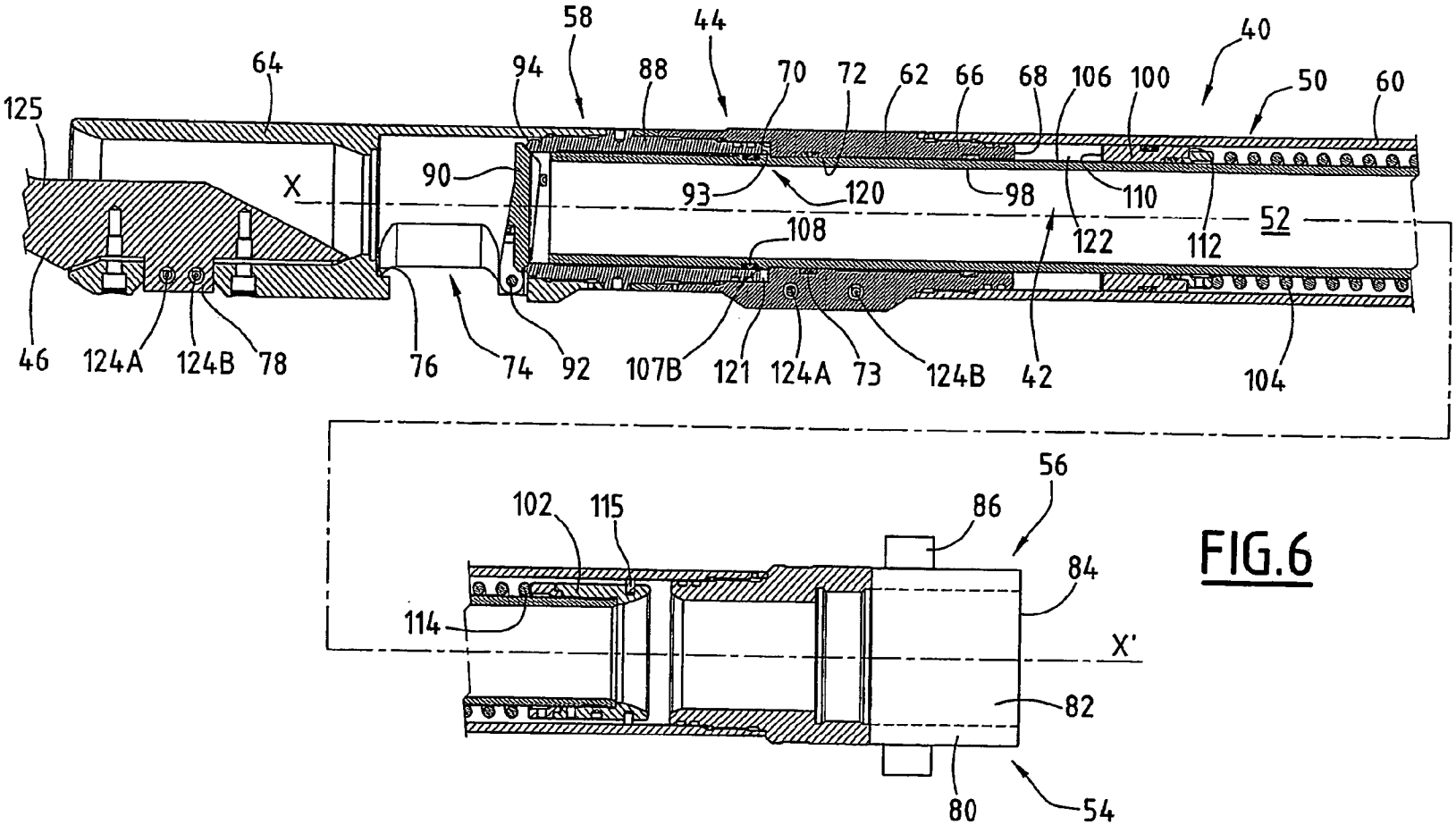
FIG. 6 is a similar view to FIG. 3 in which the valve of the safety device is sealed.

In the sealed position, illustrated in FIG. 6, the shutter 90 extends in a plane that is substantially perpendicular to the longitudinal axis X-X' of the valve housing 40. It rests on the distal conical annular surface 94 to seal the passage 52.

The spring 92 permanently biases the shutter 90 towards its sealed position.

The means 42 for holding the valve in its open position comprise a cylindrical sleeve 98 mounted movably in translation along the axis X-X' in the passage 52, between a proximal rest position and a distal open position of the valve 58. The means 42 further comprise, mounted on the sleeve 98, a distal pressurisation piston 100, a proximal end stop 102 for guiding the sleeve, and a spiral spring 104 for returning the sleeve to its proximal position.

Figure 4:
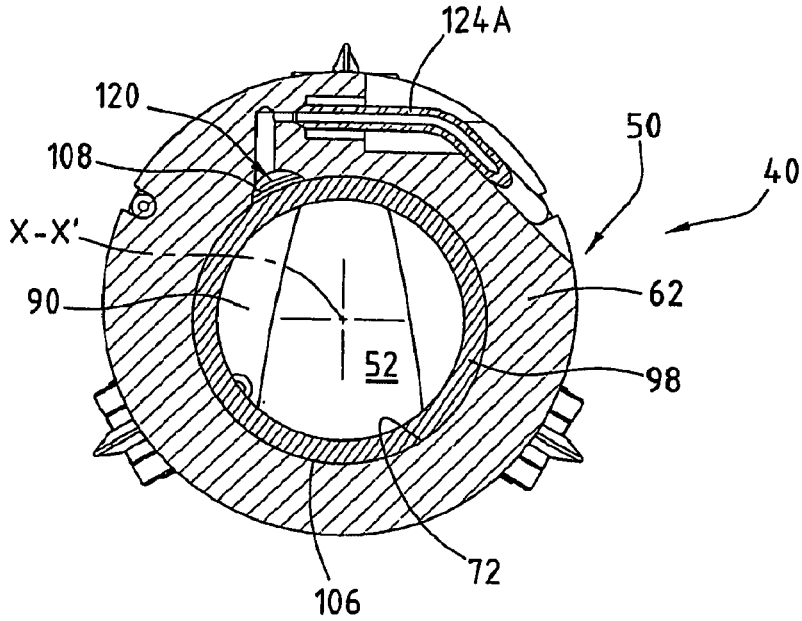
FIG. 4 is a lateral cross-sectional view along the plane IV-IV of FIG. 3.

The sleeve 98 extends longitudinally in the body 40 opposite the proximal tubular portion 60, the mid-portion 62 and, in its proximal position, the distal portion 64. As illustrated in FIG. 4, it comprises an outer surface 106 of transverse cross-section substantially complementary to the guide surface 72 of the mid-portion 62 in such a way that the mid-portion 62 guides the sleeve 98 when it moves between its proximal position and its distal position.

As illustrated in FIG. 3A, the surface 106 delimits with the seat 88, an annular space 107. It comprises an annular rib 107B which delimits a distal recess oriented towards the seat 88. The recess receives a sealing gasket 108 which distally seals the annular space 107. The space 107 is sealed proximally by the proximal gasket 73.

The distal annular piston 100 is mounted slidingly on the sleeve 98 between the outer surface 106 and the proximal tubular portion 60. It delimits a distal annular surface 110 which extends opposite the proximal surface 68. It further delimits a proximal annular surface 112 on which a distal end of the spring 104 rests.

The proximal annular end stop 102 is mounted integrally with the proximal end of the sleeve 98. It extends between the sleeve 98 and the tubular portion 60. The end stop 102 slides in the tubular portion 60 and delimits a distal annular surface 114 on which the proximal end of the spring 104 rests. The end stop 102 comprises a wiper gasket 115 arranged resting on the tubular portion 60.

In the proximal position of the sleeve 98, illustrated in FIG. 6, the gasket 108 extends in the vicinity of the proximal surface 93 of the seat 88. In addition, the end stop 102 is situated in the vicinity of the receiving head 80. The distance separating the piston 100 and the end stop 102 is then at the maximum. The spring 104 is pre-stressed in such a way that it exerts a minimal return force on the piston 100 and on the end stop 102. In this position, the annular rib 107B of the sleeve 98 rests against the shoulder 70.

In this position, the distal edge of the sleeve 98 is arranged opposite the seat 88, proximally in relation to the shutter 90.

In the distal position of the sleeve 98, illustrated in FIG. 3, the distance between the piston 100 and the end stop 102 is minimal and the compression of the spring 104 is at the maximum in such a way that it exerts maximum return force on the piston 100 and on the end stop 102.

In this position, a distal portion of the sleeve 98 extends opposite the lateral opening 74. The distal edge of the sleeve 98 rests on the end stop shoulder 76 of the distal portion 64. The sleeve 98 covers the shutter 90. In addition, the gasket 108 is at a distance distally from the proximal surface 93 of the valve seat 88.

As illustrated in FIGS. 3 to 6, the hydraulic cylinder 44 comprises a pressurising chamber 120 and a reserve and discharge tank 122 which are connected hydraulically to the unit 46 by the respective connection conduits 124A, 124B. The tank 122 and the chamber 120 contain a hydraulic fluid for controlling the cylinder 44.

The chamber 120 comprises an intermediate space 121 of constant volume and the annular space 107 of variable volume.

The intermediate space 121 extends between the body 50 and the sleeve 98. It is delimited proximally by the distal shoulder 70 of the mid-portion 62, by the proximal surface 93 of the seat 88, and by the outer surface 106 of the sleeve. The space 121 is connected to the annular space 107.

In the proximal position of the sleeve 98, the distance between the proximal gasket 73 and the distal gasket 108 is minimal and the volume of the chamber 120 is minimal. In the distal position of the sleeve 98, this distance is at the maximum and the volume of the chamber 120 is at the maximum.

The tank 122 extends between the body 50 and the sleeve 98 proximally in relation to the chamber 120. It is delimited by the proximal tubular portion 60, by the proximal surface 68 of the mid-portion 62, by the surface 106, and by the distal surface 110 of the piston 100.

The volume of the tank 122 depends on the longitudinal position of the piston 100 along the sleeve 98 and along the body 50.

As illustrated in FIG. 2, the conduits 124A, 124B extend outside the body 50 along said body. They open out distally in the region of the lateral passage 78 for assembling the unit 46. In addition, the distal connection conduit 124A opens proximally in the intermediate space 121 of the chamber 120 via the mid-portion 62.

The proximal connection conduit 124B opens proximally in the tank 122 through the mid-portion 62.

Figure 5:
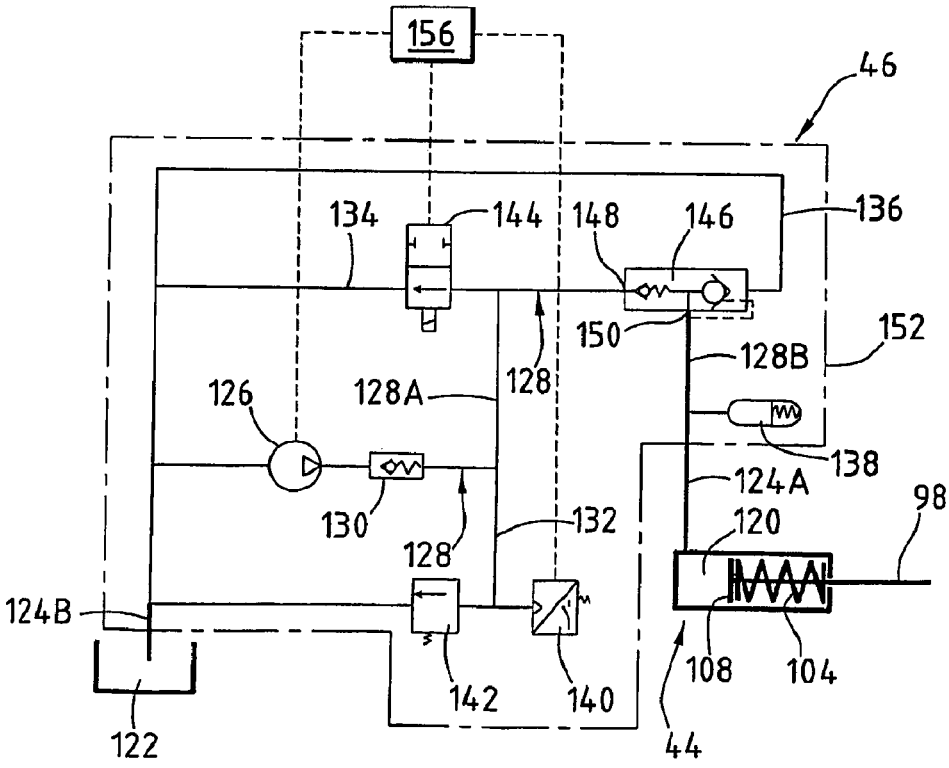
FIG. 5 is a diagrammatic view of the hydraulic actuating means of the device in FIG. 2.

As illustrated in FIG. 5, the unit 46 comprises a tubular housing 125 receiving a hydraulic electric pump 126 and a conduit 128 for selectively pressurising the chamber 120, connecting the electric pump 126 to the distal connection conduit 124A.

The tubular housing 125 projects distally outside the body 50 along the axis X-X'. The proximal end thereof is introduced into the distal opening of the distal portion 64 and received in the assembly passage 78 in order to be fixed to the distal portion 64 of the body 50.

The electric pump 126 connects the proximal connection conduit 124B to an inlet of the conduit 128 so as to connect the tank 122 to the conduit 128.

The pressurising conduit 128 comprises, from upstream to downstream, from the electric pump 126 to the chamber 120, a zero-leak non-return valve 130 and an upstream portion 128A on which are fastened a safety conduit 132 and a first discharge conduit 134 received in the housing 125. The conduit 128 also comprises a downstream portion 128B on which are connected a rapid discharge conduit 136 and an accumulator 138, received in the tubular housing 125.

The safety conduit 132 is connected on the upstream portion of the pressurising conduit 128 at the outlet of the valve 130. It opens at the inlet of the proximal connection conduit 124B. The safety conduit 132 is provided, from upstream to downstream, with a pressure switch 140 and a pressure relief valve 142.

The first discharge conduit 134 is fastened on the upstream portion 128A of the conduit 128 downstream of the conduit 132. The conduit 134 is provided with a controlled safety solenoid valve 144, which is normally open, and which opens into the proximal connection conduit 124B.

The solenoid valve 144 is connected electrically to the control means 48.

The rapid discharge conduit 136 is connected on the pressurising conduit 128 by means of a bypass valve 146, delimiting the upstream portion 128A and the downstream portion 128B on the conduit 128.

The valve 146 comprises a primary inlet 148 and a primary outlet 150 opening respectively into the upstream portion 128A of the pressurising conduit 128 towards the electric pump 126, and into the downstream portion 128B of the conduit 128 towards the chamber 120. The valve 146 also comprises a secondary outlet 152 connected to the rapid discharge conduit 136.

When the pressure that prevails in the region of the primary inlet 148 is greater than or substantially equal to the pressure that prevails in the region of the primary outlet 150, the secondary outlet 152 is sealed in such a way that the primary inlet 148 is connected hydraulically to the primary outlet 150.

On the other hand, when the pressure that prevails in the region of the primary inlet 148 is less than the pressure that prevails in the region of the primary outlet 150, the primary inlet 148 is sealed and the primary outlet 150 is connected hydraulically to the secondary outlet 152 and thus to the tank 122 by means of the conduit 124B.

The minimum flow cross-section through the downstream portion 128B, the secondary outlet 152 and through the rapid discharge conduit 136 is very much greater than the maximum flow cross-section through the upstream portion 128A, the solenoid valve 144 and through the first discharge conduit 134, for example at least twice as great.

As illustrated in FIG. 2, the control means 48 are received in the tubular housing 125. They comprise a receiver 154 and a unit 156 for controlling the cylinder 44. The receiver 154 is able to receive a valve open control signal emitted from the surface and to transmit an order to the control unit 156 to hold the shutter 90 in its open position, for as long as the control signal is received by the receiver 154.

The receiver 154 is also able to receive a temporary silence signal for the well 12 and to transmit an order to the control unit 156, to hold the shutter 90 temporarily in its open position even in the absence of a valve open signal.

The control unit 156 is connected electrically to the solenoid valve 144, to the electric pump 126, and to the pressure switch 140 for controlling the cylinder 44.

The operation of the autonomous safety device 10 according to the invention to replace a defective valve in the well 12 will now be described.

Initially, a valve housing 40 is selected of suitable dimensions for insertion into the second conduit 20.

A hydraulic unit 46 common to valve housings 40 of different diameters is fixed in the lateral passage 78 and is connected hydraulically to the distal ends of the conduits 124A and 124B.

The autonomous device 10 according to the invention is thus formed.

Then, with reference to FIG. 1B, the deployment means 14 are arranged on the wellhead 22. The installation gear 31 is mounted on the receiving head 80 at the proximal end of the valve housing 40.

The valve housing 40, the holding means 42, the hydraulic actuating cylinder 44 and the hydraulic unit 46 connected to the housing 40, forming the device 10, are then introduced into the second conduit 20 and are thus lowered simultaneously under the control of the working wire line 30.

When the device 10 reaches the desired position in the second conduit 20, for example when the anchoring means 56 are arranged opposite an engagement recess 26B, the working wire line 30 is halted.

The anchoring means 56 are then actuated by the operator to lock the housing 40 in position in the conduit 20.

Accordingly, the engagement dogs 86 are inserted in the recesses 26B and a sealed connection is formed between the housing 40 and the second conduit 20. Then, the installation gear 31 is released from the connection means 54, to free the opening 84 at the inlet of the passage 52. The deployment means 14 are then withdrawn (FIG. 1A).

The shutter 90 is maintained in the position in which it seals the passage 52, the sleeve 98 being in its proximal position.

The safety device 10 then tightly seals the second conduit 20.

When the well operator wishes to open the second conduit 20, he actuates the emission means 35 at the surface to emit a valve open control signal.

When the receiver 154 receives the valve open control signal, it transmits an actuation order to the control unit 156. The unit 156 then actuates the electric pump 126 and the solenoid valve 144 to introduce a portion of the liquid contained in the tank 122 into the chamber 120. The volume of the tank 122 reduces, which causes the distal movement of the piston 100.

In this regard, the priming of the electric pump 126 is assisted by the presence of the pre-stressed return spring 104 which rests on the piston 100 when the sleeve 98 is in its proximal position, to compress slightly the fluid contained in the tank 122.

Once the electric pump 126 is primed and the solenoid valve 144 is closed, the pressure in the chamber 120 increases and is applied in the annular space 107, between the proximal gasket 73 and the distal gasket 108, which causes the sleeve 98 to move towards its distal position, against the return spring 104 which is compressed between the piston 100 and the end stop 102.

During this movement, the distal edge of the sleeve 98 pushes the shutter 90, and moves it from the sealed position to its open position, against the biasing spring 92.

When the sleeve 98 has reached the position in which it comes to a stop against the end-stop shoulder 76, the shutter 90 is secured against the distal portion 64 and seals the lateral opening 74, as illustrated in FIG. 3.

Moreover, the pressure in the chamber 120 increases to a threshold value which is detected by the pressure switch 140 and transmitted to the unit 156. When the control unit 156 determines that the pressure in the chamber 120 is greater than the threshold value, it disconnects the electric pump 126.

The solenoid valve 144 is kept sealed for as long as the receiver 154 receives a valve open control signal.

If the pressure in the chamber 120 falls below a re-start value for the electric pump 126, the control unit 156 actuates the electric pump 126 once again to raise the pressure in the chamber 120 to the threshold value.

However, the presence of a zero-leak non-return valve 130 reduces the operating time of the electric pump 126 and increases the autonomy of the device 10.

The accumulator 138 allows pressure variations in the chamber 120, due in particular to temperature variations in the housing 40, to be compensated.

In the event of an incident at the surface, the valve open control signal emitted by the emission means 35 is disconnected.

Once the receiver 154 no longer receives said signal, the control unit 156 determines whether a temporary silence signal has been emitted before disconnecting the valve open control signal. In the absence of such a silence signal, the control unit 156 deactivates the solenoid valve 144 and then resumes its normally open position.

With reference to FIG. 5, the fluid contained in the upstream portion 128A of the conduit 128, upstream of the primary inlet 148 of the rapid discharge valve 146 is then reintroduced into the tank 122 via the first discharge conduit 134 and the proximal connection conduit 124B.

The pressure that prevails in the region of the primary inlet 148 thus reduces to a value below that which prevails at the primary outlet 150.

As a follow-up, the secondary outlet 152 of the rapid discharge valve 146 opens, and the primary inlet 148 closes. The fluid contained in the pressurising chamber 120 is therefore discharged very rapidly into the tank 122 via the downstream portion 128B of the conduit 128, the primary outlet 150, the secondary outlet 152, the rapid discharge conduit 136 and the proximal connection conduit 124B.

As the pressure in the chamber 120 falls rapidly, the return spring 104 moves the sleeve 98 towards its proximal position very rapidly. It will be noted that only one spring 104 is necessary to pressurise the tank 122 when the pump 104 is deactivated, and to allow the sleeve 98 to return towards its proximal position in the event of an incident at the surface. The length of the housing 40 is thus reduced. In addition, since the volume of the tank 122 increases after the rapid discharge valve 146 opens, the difference in length of the spring 104 resting proximally on the piston 100 between the proximal position and the distal position of the sleeve 98 is less than the travel of the sleeve 98 between said positions.

The biasing spring 92 then returns the shutter 90 to its sealed position across the passage 52, as illustrated in FIG. 6. The well 12 is thus made safe.

However, if the operator has issued a previously programmed silence signal, before the disconnection of the valve open signal, the control unit 156 maintains the solenoid valve 144 sealed and the chamber 120 under pressure for a determined period of time, despite the absence of a control signal. The shutter 90 therefore remains in the open position.

This operating method maintains production of the well 12, even if an intervention requiring the absence of any control signal must be carried out on another nearby well.

If a control signal is once more emitted, the control unit 156 is reinitialised, such that the disconnection of the control signal causes the shutter 90 to close once more.

With the aid of the invention that has just been described, it is possible to have an autonomous safety device 10 that is easily installed and anchored in a well 12 by a working wire line 30. Said device comprises a valve housing 40, means 42 for holding the valve in an open position, and hydraulic actuating means 44, 46 holding means 42, connected to the housing 40, for the simultaneous movement thereof in the well 12.

Such a device 10 can be used at any point in the well 12, without the need to introduce hydraulic or electric control lines, either to replace an existing defective valve in the well 12, or to install a new valve in the well 12 without having to raise the production casing.

The arrangement of the hydraulic unit 46 in the valve housing frees the fluid flow passage 52 inside the valve housing and opens a passage 52 of sufficient diameter for the production of hydrocarbons or the passage of tools as far as the shutter 90.

The structure of the hydraulic unit 46 is suitable for connection thereof to valve housings 40 of different diameters. In addition, the structure thereof consumes little energy, for autonomous operation of the device 10 over a long period of between six months and two years without the need to raise the device 10 to the surface.

The invention claimed is:

1. A safety device for a fluid production well, comprising:

a valve housing to be fixed tightly inside a fluid flow conduit, the valve housing delimiting a fluid flow passage, the valve housing comprising a valve used to seal the passage, and which can move between an open position of the passage and a closed position of the passage, means for permanently biasing the valve towards the closed position, and means for connecting the valve housing to a coupling member for a working wire line intended to move and anchor the valve housing in the conduit;

means for holding the valve in the open position against the permanent biasing means, the holding means comprising a movement element for the valve, the movement element being movable in the valve housing between a rest position and an active valve biasing position of the valve, and a return element permanently biased for returning the movement element to the rest position;

a hydraulic cylinder for hydraulically actuating the holding means; and a hydraulic control unit for controlling the hydraulic cylinder by a control signal so as to actuate the holding means upon receipt of a valve open control signal by the hydraulic control unit, and so as to deactivate the holding means in the absence of the valve open control signal, wherein the holding means, the hydraulic cylinder and the hydraulic control unit are connected to the valve housing so as to be simultaneously movable together with the valve housing under the control of the working wire line.

2. The device according to claim 1, wherein the hydraulic control unit projects at least partially in relation to the valve housing along a longitudinal axis of the valve housing, outside the flow passage, the flow passage being clear between the connecting means and the valve.

3. The device according to claim 1, wherein the hydraulic control unit can be removed from the valve housing, the valve housing comprising a receiving portion for receiving the hydraulic control unit.

4. The device according to claim 1, wherein the hydraulic cylinder comprises:

a control fluid pressurizing chamber, the control fluid pressurizing chamber receiving a portion of the movement element of the holding means; and a control fluid reserve and discharge tank, and wherein the hydraulic control unit comprises:

a pump for feeding the control fluid into the pressurizing chamber;

a pressurizing conduit connecting the pressurizing chamber to the discharge tank; and a first discharge conduit fastened on the pressurizing conduit and provided with a discharge valve that is open in the absence of the valve open control signal, and closed in the presence of the valve open control signal.

5. The device according to claim 4, wherein the return element stresses a pressurization piston of the discharge tank.

6. The device according to claim 4, wherein the hydraulic control unit comprises a rapid discharge conduit fastened on the pressurizing conduit, the rapid discharge conduit being provided with a sealing element that can be released when the discharge valve is open.

7. The device according to claim 6, wherein a maximum cross-section of the first discharge conduit and of an upstream portion of the pressurizing conduit situated upstream of the releasable sealing element is less than a minimum cross-section of the rapid discharge conduit and of a downstream portion of the pressurizing conduit situated downstream of the releasable sealing element.

8. The device according to claim 4, wherein the hydraulic control unit comprises a control fluid accumulator connected to the pressurizing chamber.

9. The device according to claim 4, wherein the hydraulic control unit comprises a zero-leakage non-return valve, interposed between the pump and the pressurizing chamber.

10. The device according to claim 1, wherein the hydraulic control unit comprises:

a receiver; and a control unit which is able to drive the hydraulic cylinder so as to actuate the holding means upon reception of the valve open control signal by the receiver, and so as to deactivate the holding means in the absence of the valve open control signal.

11. The device according to claim 10, wherein the control unit is configured for driving the hydraulic cylinder so as to actuate at least temporarily the holding means in the absence of the valve open control signal, after receipt of a silence signal by the receiver.

12. The device according to claim 1, further comprising releasable means for anchoring the valve housing in the conduit, carried by the valve housing.

13. Safety installation for a fluid production well comprising a fluid flow conduit, said installation comprising:

a device according to any one of the preceding claims; and a working wire line for deploying said device in the conduit, the working wire line being connected to the connecting means.

* * * * *